US010748685B2

(12) United States Patent
Fujikawa et al.

(10) Patent No.: US 10,748,685 B2
(45) **Date of Patent: *Aug. 18, 2020**

(54) R-T-B BASED SINTERED MAGNET

(71) Applicant: TDK CORPORATION, Tokyo (JP)

(72) Inventors: Yoshinori Fujikawa, Tokyo (JP); Masashi Miwa, Tokyo (JP)

(73) Assignee: TDK CORPORATION, Tokyo (JP)

( * ) Notice: Subject to any disclaimer, the term of this patent is extended or adjusted under 35 U.S.C. 154(b) by 173 days.

This patent is subject to a terminal disclaimer.

(21) Appl. No.: 15/939,719

(22) Filed: Mar. 29, 2018

(65) Prior Publication Data

US 2018/0301256 A1 Oct. 18, 2018

(30) Foreign Application Priority Data

Mar. 30, 2017 (JP) ..... 2017-069147
Mar. 22, 2018 (JP) ..... 2018-055201

(51) Int. Cl.
*H01F 1/057* (2006.01)
*H01F 41/02* (2006.01)
(Continued)

(52) U.S. Cl.
CPC ..... *H01F 1/0577* (2013.01); *C22C 38/002* (2013.01); *C22C 38/005* (2013.01);
(Continued)

(58) Field of Classification Search
None
See application file for complete search history.

(56) References Cited

U.S. PATENT DOCUMENTS 10,242,780 B2 * 3/2019 Ohsawa ..... H01F 1/0577
10,256,017 B2 * 4/2019 Ohsawa ..... H01F 1/0577
(Continued)

FOREIGN PATENT DOCUMENTS

JP S59-46008 A 3/1984
JP H02-149650 A 6/1990
(Continued)

*Primary Examiner* — Xiaowei Su
(74) *Attorney, Agent, or Firm* — Oliff PLC

(57) ABSTRACT

An R-T-B based sintered magnet including main phase particles having an $R_2T_{14}B$ type crystal structure. R is at least one rare earth element essentially including a heavy rare-earth element RH. T is at least one transition metal element essentially including Fe or Fe and Co. B is boron. At least one of the main phase particles includes low RH crystal phases inside the main phase particle. The low RH crystal phases include the $R_2T_{14}B$ type crystal structure, wherein an RH concentration in the low RH crystal phases is relatively lower than the RH concentration in the whole main phase particles. The R-T-B based sintered magnet may satisfy $r_s - r_c \geq 20\%$ when an existence ratio of the main phase particles including the low RH crystal phases in a magnet surface layer part is $r_s$ (%) and the same in a magnet central part is $r_c$ (%).

4 Claims, 1 Drawing Sheet

(51) Int. Cl.

| | |
|---|---|
| ***C22C 38/00*** | (2006.01) |
| ***C22C 38/10*** | (2006.01) |
| ***C22C 38/16*** | (2006.01) |
| ***C22C 38/06*** | (2006.01) |
| ***C22C 38/14*** | (2006.01) |

(52) U.S. Cl.

CPC ..... *C22C 38/06* (2013.01); *C22C 38/10* (2013.01); *C22C 38/14* (2013.01); *C22C 38/16* (2013.01); *H01F 41/0293* (2013.01); *C22C 2202/02* (2013.01); *H01F 41/0266* (2013.01)

(56) References Cited

U.S. PATENT DOCUMENTS

| | | | | |
|---|---|---|---|---|
| 2008/0245442 | A1 | 10/2008 | Nakamura et al. | |
| 2011/0150691 | A1 | 6/2011 | Nakamura et al. | |
| 2014/0184370 | A1* | 7/2014 | Hidaka | C22C 33/02 335/302 |
| 2016/0240292 | A1* | 8/2016 | Ohsawa | H01F 1/0577 |
| 2018/0301257 | A1* | 10/2018 | Fujikawa | H01F 41/0293 |

FOREIGN PATENT DOCUMENTS

| | | | | |
|---|---|---|---|---|
| JP | 2016-154219 | A | 8/2016 | |
| WO | 2006/043348 | A1 | 4/2006 | |
| WO | WO-2012161355 | A1 * | 11/2012 | C22C 33/02 |

* cited by examiner

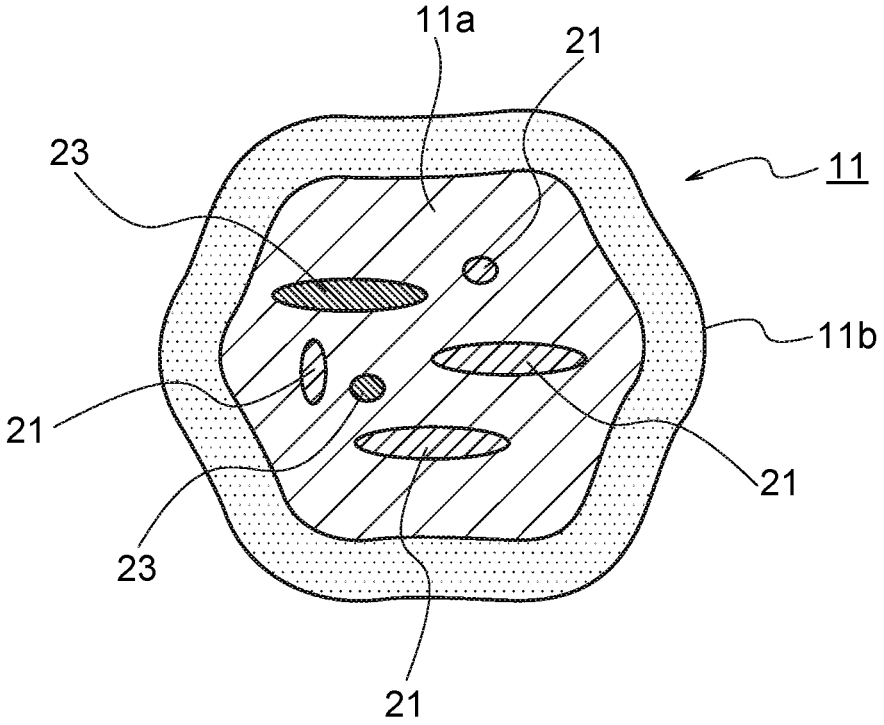
11a
21
23
11
11b
21
21
23
21

R-T-B BASED SINTERED MAGNET

BACKGROUND OF THE INVENTION

1. Field of the Invention

The present invention relates to an R-T-B based sintered magnet.

2. Description of the Related Art

As disclosed in Patent Document 1, it is known that the R-T-B based sintered magnet has excellent magnetic properties. At present, further improvement of the magnetic properties is desired.

As a method for improving the magnetic properties, particularly coercive force, of the R-T-B based sintered magnet, a method of adding a heavy rare earth element as R (a one-alloy method) when producing the raw material alloy is known. Further, there is a method (a two-alloy method) of pulverizing a main phase alloy not including the heavy rare earth elements and a grain boundary phase alloy including the heavy rare earth elements, then mixing and sintering thereof. Furthermore, as disclosed in Patent Document 2, there is a method (a grain boundary diffusion method) of diffusing the heavy rare earth elements via grain boundaries by adhering the heavy rare earth elements on the surface and heating thereof after producing the R-T-B based sintered magnet.

According to the above one alloy process, a maximum energy product may be lowered in some cases due to the heavy rare earth elements existing in the main phase particle. According to the two-alloy method, it is possible to reduce the heavy rare earth elements in the main phase particle and to suppress a decrease in the maximum energy product. In the grain boundary diffusion method, it is possible to increase the concentration of the heavy rare earth elements only in a region close to the grain boundary among the main phase particles, and to reduce the concentration of the heavy rare earth elements inside the main phase particle. That is, main phase particles having a general core-shell structure can be obtained. A general core-shell structure is a structure in which the concentration of the heavy rare earth elements in the core part is lower than the concentration of the heavy rare earth elements in the shell part covering the core part. This makes it possible to increase coercive force and suppress the lowering of the maximum energy product, as compared with the two-alloy method. Furthermore, the amount of expensive heavy rare earth elements used can be suppressed.

In addition, Patent Document 3 discloses a technique including main phase particles, in which a concentration of the heavy rare earth elements in the core part is higher than the same in the shell part, to improve the coercive force as compared with the conventional R-T-B based sintered magnet.

Patent Document 1: JP-S59-46008A

Patent Document 2: International Publication No. 2006/043348

Patent Document 3: JP-2016-154219A

SUMMARY OF THE INVENTION

However, at present, further improvement of coercive force and cost reduction are required.

One of the objects of the present invention is to improve magnetic properties and to obtain a low-cost R-T-B based sintered magnet.

To achieve the object, the present invention discloses the following.

An R-T-B based sintered magnet including a plural number of main phase particles having an $R_2T_{14}B$ type crystal structure, in which R is at least one rare earth element essentially including a heavy rare-earth element RH, T is at least one transition metal element essentially including Fe or Fe and Co, and B is boron, at least one of the main phase particles includes a plural number of low RH crystal phases therein, and the low RH crystal phases include the $R_2T_{14}B$ type crystal structure, in which an RH concentration in the low RH crystal phases is relatively lower than the RH concentration in the whole main phase particles.

By having the above properties, the R-T-B based sintered magnet of the invention improves its magnetic properties and becomes a low-cost magnet.

The R-T-B based sintered magnet of the invention may satisfy $r_s - r_c \geq 20\%$ when an existence ratio of the main phase particles including the low RH crystal phases in a magnet surface layer part is $r_s$ (%) and the same in a magnet central part is $r_c$ (%).

The R-T-B based sintered magnet of the invention in which at least one of the main phase particles including the low RH crystal phase may further include a nonmagnetic R-rich phase therein.

The R-T-B based sintered magnet of the invention in which at least one of the main phase particles is a reverse core-shell main phase particle including a core part and a shell part, in which $C_{RC}/C_{RS} > 1.0$ is satisfied when a total RH concentration (at %) in the core part as $C_{RC}$ and a total RH concentration (at %) in the shell part as $C_{RS}$.

The R-T-B based sintered magnet of the invention may include the low RH crystal phase in the core part.

The R-T-B based sintered magnet of the invention may further include the nonmagnetic R-rich phase in the core part.

BRIEF DESCRIPTION OF THE DRAWING

The FIGURE is a schematic view of a nonuniform particle of the present invention.

DESCRIPTION OF THE PREFERRED EMBODIMENTS

Hereinafter, the present invention is described based on the embodiments shown in the FIGURE.

<R-T-B Based Sintered Magnet>

The R-T-B based sintered magnet according to the present embodiment includes main phase particles including $R_2T_{14}B$ type crystal structures. R is at least one rare earth element essentially including heavy rare earth elements RH, T is at least one transition metal element essentially including Fe or Fe and Co, and B is boron. Further, the R-T-B based sintered magnet may include Zr. The rare earth element included as R refers to Sc, Y and lanthanoid elements belonging to the third group of a long period type periodic table. In addition, the heavy rare earth elements RH are Gd, Tb, Dy, Ho, Er, Tm, Yb and Lu. Light rare earth elements RL are the rare earth elements other than the heavy rare earth elements RH.

An R content is not particularly limited, and it may be 25 mass % or more and 35 mass % or less, and preferably 28 mass % or more and 33 mass % or less. When the R content is 25 mass % or more, the $R_2T_{14}B$ crystal which becomes the main phase particle of the R-T-B based sintered magnet tends to be formed sufficiently, deposition of such as α-Fe having soft magnetism tends to be suppressed, and the deterioration in magnetic properties tends to be suppressed. When the R content is 35 mass % or less, the residual magnetic flux density Br of the R-T-B based sintered magnet 1 tends to be improved.

The B content in the R-T-B based sintered magnet according to the present embodiment may be 0.5 mass % or more and 1.5 mass % or less, preferably 0.8 mass % or more and 1.2 mass % or less, and more preferably 0.8 mass % or more and 1.0 mass % or less. When the B content is 0.5 mass % or more, the coercive force Hcj tends to be improved. Further, when the B content is 1.5 mass % or less, the residual magnetic flux density Br tends to be improved.

T may be Fe alone, or a part of Fe may be substituted with Co. The Fe content in the R-T-B based sintered magnet according to the present embodiment is a substantial balance when unavoidable impurities, O, C and N are removed from the R-T-B based sintered magnet. The Co content is preferably zero mass % or more and four mass % or less, more preferably 0.1 mass % or more and 2 mass % or less, and furthermore preferably 0.3 mass % or more and 1.5 mass % or less. The transition metal elements other than Fe or Fe and Co are not particularly limited, and examples thereof include such as Ti, V, Cr, Mn, Ni, Cu, Zr, Nb, Mo, Hf, Ta and W. In addition, a part of the transition metal element included as T may be substituted with an element such as Al, Ga, Si, Bi and Sn.

When the R-T-B based sintered magnet includes one or two selected from Al and Cu, the content of one or two selected from Al and Cu is preferably 0.02 mass % or more and 0.60 mass % or less each. By respectively including 0.02 mass % or more and 0.60 mass % or less of one or two selected from Al and Cu, the coercive force and moisture resistance of the R-T-B based sintered magnet tends to be improved, and the temperature properties tend to be improved. The Al content is preferably 0.03 mass % or more to 0.40 mass % or less, and more preferably 0.05 mass % or more to 0.25 mass % or less. Further, the Cu content is preferably more than zero mass % and 0.30 mass % or less, more preferably more than zero mass % and 0.20 mass % or less, and further preferably 0.03 mass % or more and 0.15 mass % or less.

The R-T-B based sintered magnet may further include Zr. The Zr content may be more than zero mass % and 0.25 mass % or less. By including Zr within the above range, abnormal growth of the main phase particles can be suppressed in producing process of the sintered magnet, mainly in the sintering process. Therefore, the structure of the obtained sintered body (R-T-B based sintered magnet) becomes uniform and fine structure, and the magnetic properties of the obtained sintered body tends to be improved. To obtain the above effect more satisfactorily, the Zr content may be 0.03 mass % or more and 0.25 mass % or less.

Further, the C content in the R-T-B based sintered magnet is preferably 0.05 mass % or more and 0.30 mass % or less. By setting the C content to 0.05 mass % or more, the coercive force tends to be improved. By setting the C content to 0.30 mass % or less, a squareness ratio (Hk/Hcj) tends to be sufficiently high. Hk is the magnetic field strength when the magnetization in the second quadrant of the magnetic hysteresis loop (4πI-H curve) is 90% of the residual magnetic flux density (Br). The squareness ratio is a parameter indicating the ease of demagnetization due to the action of an external magnetic field and the temperature rise. When the squareness ratio is small, the demagnetization due to the action of the external magnetic field and the temperature increase becomes large. In addition, the strength of the magnetic field required for magnetization increases. To obtain more preferred coercive force and squareness ratio, it is preferable to set the C content to 0.10 mass % or more and 0.25 mass % or less.

Further, the O content in the R-T-B based sintered magnet is preferably 0.03 mass % or more and 0.40 mass % or less. By setting the O content to 0.03 mass % or more, corrosion resistance tends to be improved. When the O content is 0.40 mass % or less, a liquid phase tends to be sufficiently formed when sintering, and coercive force tends to be improved. To obtain more preferable corrosion resistance and coercive force, the O content may be 0.05 mass % or more and 0.30 mass % or less, and may be 0.05 mass % or more and 0.25 mass % or less.

Further, the N content in the R-T-B based sintered magnet is preferably zero mass % or more and 0.15 mass % or less. When the N content is 0.15 mass % or less, the coercive force tends to be sufficiently improved.

The R-T-B based sintered magnet may include inevitable impurities such as Mn, Ca, Ni, Cl, S, and F in an amount of approximately 0.001 mass % or more and 0.5 mass % or less.

As a method of measuring the amounts of oxygen, carbon, and nitrogen in the R-T-B based sintered magnet, conventionally well-known methods can be used. The oxygen amount is measured by such as an inert gas fusion-non dispersive infrared absorption method, and the carbon amount is measured by such as an in oxygen stream combustion-infrared absorption method, and the nitrogen amount is measured by such as an inert gas fusion-thermal conductivity method.

The grain diameter of the main phase particle including the $R_2T_{14}B$ type crystal structures is not particularly limited, but it is usually 1 μm or more and 10 μm or less.

The type of R is not particularly limited, but preferably includes Nd and Pr. Furthermore, the type of the heavy rare earth elements RH is also not particularly limited, but preferably include either one or both of Dy and Tb.

As shown in the FIGURE, the R-T-B based sintered magnet according to the embodiment is characterized by including nonuniform main phase particles 11 including a plurality of low RH crystal phases 21 therein.

In addition, a number ratio of nonuniform main phase particles 11, including a plurality of low RH crystal phases 21 therein, with respect to all the main phase particles included in the R-T-B based sintered magnet may be 0.1% or more and 5% or less.

The low RH crystal phase 21 is an $R_2T_{14}B$ crystal phase having a lower concentration of the heavy rare earth element RH than that of the main phase existing around the low RH crystal phase 21. More specifically, the $R_2T_{14}B$ crystal phase satisfies N1−L1≥0.2 when the total RH concentration (at %)/the total RL concentration (at %) in the low RH crystal phase 21 is L1, the total RH concentration (at %)/the total RL concentration (at %) in the main phase existing around the low RH crystal phase is N1. In the R-T-B based sintered magnet according to the present embodiment, it is preferable that the average of N1−L1 is 0.3 or more for improving the coercive force. The average of N1−L1 is a value obtained by averaging the results of measuring N1−L1 for individual low RH crystal phases 21 included in the R-T-B based sintered magnet.

The presence of the low RH crystal phase 21 can be confirmed by SEM, SEM-EDS, TEM and TEM-EDS. Specifically, it can be confirmed by SEM that some different phases exist in the main phase particles. It can be confirmed by TEM that the different phase is the $R_2T_{14}B$ crystal phase. Furthermore, N1−L1 of the different phase can be specified by TEM-EDS.

Here, the size of one low RH crystal phase 21 is set to 30 nm or more. The size of the low RH crystal phase 21 is the distance between two points in the case where the distance between arbitrary two points in the low RH crystal phase 21 is the maximum. In other words, a different phase having a size of less than 30 nm is not regarded as the low RH crystal phase 21. The average of the sizes of the low RH crystal phases 21 included in the R-T-B based sintered magnet according to the present embodiment is not particularly limited, but from the viewpoint of improving the coercive force, it is preferably 150 nm or more and 300 nm or less.

Although the area of one low RH crystal phase 21 is not particularly limited, it is preferably 5% or more and 30% or less in terms of the sectional area ratio with respect to the nonuniform main phase particle 11.

Further, in the R-T-B based sintered magnet according to the present embodiment, it is preferable that the content ratio of the nonuniform main phase particles 11 in the main phase particles is larger in the magnet surface layer part than in the magnet central part.

Specifically, it is preferable to satisfy $r_s - r_c \geq 20\%$ when $r_s$ (%) is the existence ratio of the main phase particles including the low RH crystal phase in the magnet surface layer part, $r_c$ (%) is the existence ratio of the main phase particles including the low RH crystal phase in the magnet central part.

Note that the magnet surface layer part refers to a region where the distance from the magnet surface is 5 μm or more and 150 μm or less, and the magnet central part is a region inside the magnet surface layer part.

The R-T-B based sintered magnet according to the present embodiment has a large number of nonuniform main phase particles 11, particularly in the magnet surface layer part. Thus, the residual magnetic flux density and the coercive force are improved.

It is considered that the nonuniform main phase particle 11 has a low RH crystal phase 21 so that a change in the anisotropic magnetic field occurs rapidly in the main phase particle. This rapid change in the anisotropic magnetic field increases a pinning force. As a result, the coercive force is improved. Furthermore, since such a large number of nonuniform main phase particles 11 are present in the magnet surface layer part, the transfer of reverse magnetic domains generated from the magnet surface is suppressed. Therefore, it is possible to improve the coercive force of the R-T-B based sintered magnet with the use of a small amount of the heavy rare-earth element RH. Furthermore, since the amount of the heavy rare-earth element RH used can be reduced, the residual magnetic flux density can also be improved. In addition, since the plurality of low RH crystal phases 21 are present in one nonuniform main phase particle 11, movement of the magnetic domain wall from any direction can be suppressed. Further, since the low RH crystal phase 21 is the $R_2T_{14}B$ based crystal phase similar to the surrounding main phases, the crystal alignment can be obtained. Therefore, the occurrence of strain is suppressed, and the coercive force improving effect is increased.

Preferably, the low RH crystal phase 21 is substantially free of the heavy rare-earth element RH. "Substantially free" means that the atomic ratio of RH/R in the low RH crystal phase 21 is 0.03 or less.

The above-mentioned effects by including the low RH crystal phase are further increased, when the low RH crystal phase 21 does not substantially include the heavy rare earth RH.

In addition, as shown in the FIGURE, it is preferable that the nonuniform main phase particles 11 further include a nonmagnetic R-rich phase 23 therein. In addition, a plurality of nonmagnetic R-rich phases 23 may be present in one nonuniform main phase particle 11.

Specifically, the nonmagnetic R-rich phase 23 is an R-rich phase in which the R content is 70 atomic % or more and 100 atomic % or less. The T/R of the nonmagnetic R-rich phase 23 is preferably 0.15 or less in terms of the atomic number ratio in order to improve the coercive force. Also, the nonmagnetic R-rich phase is not the $R_2T_{14}B$ based crystal phase.

The presence of the nonmagnetic R-rich phase 23 in the main phase particles can be confirmed by SEM, SEM-EDS, TEM and TEM-EDS. Specifically, it can be visually confirmed by the SEM image that some different phase exists inside the main phase particles, and the R content in the different phase can be specified by TEM-EDS.

By including the nonmagnetic R-rich phase 23 inside the nonuniform main phase particles 11, it is possible to generate a large anisotropic magnetic field gap in plural places within the particle. Therefore, it is possible to suppress the transfer of the motion of the domain wall from any direction, and to improve the coercive force of the R-T-B based sintered magnet.

Here, the size of one nonmagnetic R-rich phase 23 is set to 30 nm or more. The size of the nonmagnetic R-rich phase 23 is the distance between two points in the case where the distance between arbitrary two points in the nonmagnetic R-rich phase 23 is the maximum. In other words, the different phase having a size of less than 30 nm is not regarded as a nonmagnetic R-rich phase 23. The average size of the nonmagnetic R-rich phase 23 included in the R-T-B based sintered magnet according to the present embodiment is not particularly limited, but it is preferably 50 nm or more and 100 nm or less from the viewpoint of improving the coercive force.

Although the area of one nonmagnetic R-rich phase 23 is not particularly limited, it is preferably 5% or more and 15% or less in terms of the cross sectional area relative to the nonuniform main phase particle 11.

In addition, when the R-T-B based sintered magnet according to the present embodiment includes the nonuniform main phase particles 11 including the low RH crystal phase 21 and the nonmagnetic R-rich phase 23, it is preferable that the magnet to include more nonuniform main phase particles 11 in the magnet surface layer part than in the magnet central part. Specifically, it is preferable to satisfy $r_{sh} - r_{ch} \geq 20\%$ when $r_{sh}$ (%) is the existence ratio of the main phase particles including the low RH crystal phase 21 and the nonmagnetic R-rich phase 23 in the magnet surface layer part and $r_{ch}$ (%) is the existence ratio of the main phase particles including the same in the magnet central part.

According to the R-T-B based sintered magnet of the present embodiment, at least one of the main phase particles may be the reverse core-shell main phase particle. the reverse core-shell main phase particle includes the core part and the shell part. In addition, the shell part covers the core part. The core part and the shell part include the $R_2T_{14}B$ crystal phase, but their compositions are different from each other. Specifically, the RH concentration is different between the core part and the shell part. Further, it can be confirmed that the main phase particles are the reverse core-shell main phase particle by observing with SEM at a magnification of 1,000 or more to 10,000 or less times Specifically, the section obtained by cutting the R-T-B based sintered magnet of the present embodiment is mirror polished and then a backscattered electron image is taken by SEM. It is possible to discriminate from the composition contrast generated in the backscattered electron image whether each main phase particle is the core-shell main phase particle or the reverse core-shell main phase particle. Generally, the composition contrast becomes brighter (whiter) as the average atomic number of the observation target increases. In addition, the heavy rare earth elements RH has a larger atomic number as compared with other elements included in the R-T-B based sintered magnet. Therefore, in the region where the concentration of heavy rare earth elements RH is relatively high, the average atomic number becomes larger as compared with the region where the concentration of heavy rare earth elements RH is relatively low. In the backscattered electron image, a region with a high RH concentration inside the main phase particle is brighter (whiter) than a region with a low RH concentration. From the above, it can be determined whether each main phase particle is the core-shell main phase particle or the reverse core-shell main phase particle depending on the position of the bright part inside the main phase particle.

Here, the reverse core-shell main phase particles are the main phase particles including the $R_2T_{14}B$ type crystal structures. The reverse core-shell main phase particles satisfy $C_{RC}/C_{RS}>1.0$, when a total RH concentration (at %) in the core part is $C_{RC}$ and a total RH concentration (at %) in the shell part is $C_{RS}$.

That is, the reverse core-shell main phase particles are the main phase particles in which the total RH concentration in the core part is higher than that in the shell part, contrary to the generally known core-shell main phase particles.

There are no particular limitations on a measurement place of $C_{RC}$ and $C_{RS}$. For example, it can be as follows.

First, the reverse core-shell main phase particles 11 for measuring the concentration is observed with transmission electron microscope (TEM), and a diameter having a maximum length is specified. Next, two intersection points of the diameter and the grain boundary are specified. Then, the total RH concentration in a region of 20 nm×20 nm centered on a midpoint of the two intersection points can be measured, and defined as the total RH concentration $C_{RC}$ in the core part.

Next, one of the two intersection points is selected. Then, the total RH concentration in a region of 20 nm×20 nm centered at the point, penetrating the reverse core-shell main phase particle side and 20 nm apart from the intersection point along the diameter having the maximum length can be measured, and defined as the total RH concentration $C_{RS}$ in the shell part.

$C_{RC}/C_{RS}>1.5$ is preferable, and $C_{RC}/C_{RS}>3.0$ is more preferable in the reverse core-shell main phase particle included in the R-T-B based sintered magnet of the present embodiment. In the reverse core-shell main phase particle, it is preferable that the heavy rare-earth elements RH exist more in the core part than in the shell part to obtain greater above-mentioned effects and further improvement in the coercive force.

The total RH concentration with respect to the total R concentration in the core part of the reverse core-shell main phase particles is not particularly limited, but is generally about 30% or more and 80% or less in an atomic ratio. The total RH concentration with respect to the total R concentration in the shell part of the core-shell main phase particles is not particularly limited, but is generally about 10% or more and 30% or less in the atomic ratio.

It is not necessary for the shell part to cover the entire surface of the core part in the reverse core-shell main phase particle. It is sufficient that the shell part covers 60% or more of the surface of the core part. The core part and the shell part can be distinguished by SEM.

It is preferable that the existence ratio of the reverse core-shell main phase particle in the magnet surface layer part is higher than the same in the magnet central part.

Further, according to the R-T-B based sintered magnet of the present embodiment, as shown in the FIGURE, the nonuniform main phase particles 11 are preferably the reverse core-shell main phase particles having a reverse core-shell structure including the core part 11*a* and the shell part 11*b*.

Further, as shown in the FIGURE, it is preferable that the core part 11*a* includes the low RH crystal phase 21 and the nonmagnetic R-rich phase 23. In the case where the nonuniform main phase particles 11 are the reverse core-shell main phase particles, the effect of improving the coercive force becomes greater when the core part 11*a* includes the low RH crystal phase 21 and the nonmagnetic R-rich phase 23.

<Producing Method of R-T-B Based Sintered Magnet>

Next, a producing method of the R-T-B based sintered magnet according to the present embodiment will be described.

Hereinafter, the R-T-B based sintered magnet, produced by a powder metallurgy method in which the heavy rare earth elements are diffused at the grain boundary, will be described as an example, however, the producing method of the R-T-B based sintered magnet according to the present embodiment is not particularly limited, and other methods can also be used.

The producing method of the R-T-B based sintered magnet according to the present embodiment includes a pressing step of pressing a raw material powder to obtain a green compact, a sintering step of sintering the green compact to obtain a sintered body, and an aging step of maintaining the sintered body at a temperature lower than the sintering temperature for a certain period of time.

Hereinafter, the producing method of the R-T-B based sintered magnet will be described in detail, however as a matter not specified, known methods can be used.

[Preparing Step of Raw Material Powder]

The raw material powder can be prepared by a known method. In the present embodiment, the R-T-B based sintered magnet is produced by the single alloy method using one of the raw material alloy mainly including the $R_2T_{14}B$ phase, however, it may be produced by the two-alloy method using two of raw material alloys. Here, the composition of the raw material alloy is controlled so as to be the composition of the finally obtained R-T-B based sintered magnet.

First, a raw material metal corresponding to the composition of the raw material alloy of the present embodiment is prepared, and a raw material alloy of this embodiment is produced from the raw material metal. There is no particular limitation on the producing method of the raw material alloy. For example, the raw material alloy can be produced by a strip casting method.

After producing the raw material alloy, the produced raw material alloy is pulverized (a pulverization step). The pulverization step may be carried out in two stages or in one stage. The pulverization method is not particularly limited. For example, it is carried out by a method using various pulverizers. For example, the pulverization step can be carried out in two stages, a coarse pulverization step and a fine pulverization step, and in the coarse pulverization step, such as a hydrogen pulverization can be carried out. Specifically, it is possible to carry out dehydrogenation at 400° C. or more and 650° C. or less for 0.5 hour or more to two hours or less in an Ar gas atmosphere, after the raw material alloy stores hydrogen at room temperature. Further, the fine pulverization step can be carried out by using a jet mill, a wet attritor, etc., after adding such as oleic acid amide, zinc stearate, etc. to the powder after the coarse pulverization. There is no particular limitation on the grain diameter of the fine pulverized powder (the raw material powder) to be obtained. For example, it can be finely pulverized so as to be finely pulverized powder (raw material powder) having a grain diameter (D50) of 1 μm or more and 10 μm or less.

[Pressing Process]

In the pressing step, the finely pulverized powder (the raw material powder) obtained by the pulverization step is pressed into a predetermined shape. The pressing method is not particularly limited, but in the present embodiment, the finely pulverized powder (the raw material powder) is filled in a metal mold and pressurized in a magnetic field.

It is preferable to perform pressurization when pressing at 30 MPa or more and 300 MPa or less. The applied magnetic field is preferably 950 kA/m or more and 1600 kA/m or less. The shape of the green compact obtained by pressing the finely pulverized powder (the raw material powder) is not particularly limited, and it can have an arbitrary shape depending on the shape of a desired R-T-B based sintered magnet, such as a rectangular parallelepiped, a flat plate, a column, etc.

[Sintering Step]

Sintering step is a step of sintering the green compact in a vacuum or an inert gas atmosphere to obtain a sintered body. The sintering temperature needs to be adjusted according to various conditions such as composition, pulverization method, difference in grain size and grain size distribution, etc. However, it is sintered by firing at the sintering temperature of 1000° C. or more and 1200° C. or less in a vacuum or in the presence of an inert gas for one hour or more and 10 hours or less. As a result, a high dense sintered body (sintered magnet) can be obtained.

[Aging Step]

The aging step is performed by heating the sintered body (a sintered magnet) after the sintering step at a temperature lower than the firing temperature. There is no particular limitation on temperature and time of the aging, but it can be carried out, for example, at 450° C. or more and 900° C. or less for 0.2 hour or more and three hours or less. This aging step may be omitted.

Further, the aging step may be carried out in one stage or in two stages. In the case of carrying out in the two stages, for example, the first stage can be set to 700° C. or more and 900° C. or less for 0.2 hour or more and three hours or less, and the second stage can be set to 450° C. or more and 700° C. or less for 0.2 hour or more and three hours or less. Further, the first stage and the second stage may be carried out continuously, or the second stage may be carried out after once cooling to near room temperature and reheating after the first stage.

[Nonuniform Main Phase Particle Generation Step]

There is no particular limitation on a generation method of the nonuniform main phase particles including the low RH crystal phase in the present embodiment. For example, the nonuniform main phase particles can be obtained through the following decomposition step, grain boundary diffusion step and recombining step. The decomposition step, the grain boundary diffusion step and the recombining step are collectively referred to as the nonuniform main phase particle generation step.

[Decomposition Step]

The decomposition step is a step of disproportionating and making finer structures of the main phase particles, including the $R_2T_{14}B$ type crystal structure and mainly existing in the magnet surface layer part. The conditions of the decomposition step are not particularly limited as long as the main phase particles, including the $R_2T_{14}B$ type crystal structure and mainly existing in the magnet surface layer part, can be disproportionated and are made to have finer structures.

For example, by heating in an inert atmosphere including $H_2$ gas, CO gas or $N_2$ gas, at about 600° C. or more and 900° C. or less, for approximately 5 minutes or more to 60 minutes or less, $H_2$, CO or $N_2$ is stored in the main phase particles mainly existing in the magnet surface layer part. Thus, the main phase particles are disproportionated and are made to have finer structures.

By controlling the concentration of $H_2$ gas, CO gas or $N_2$ gas, heating temperature and/or heating time, the thickness of the region where the finely structured main phase particles can be controlled and distribution of the finally obtained nonuniform main phase particles can be controlled.

It is also possible to disproportionate and make finely structured main phase particles existing in the magnet surface layer part by heating in an oxidizing atmosphere including an oxidizing gas at about 300° C. or more to 500° C. or less for about 20 minutes or more to 60 minutes or less.

[Diffusion Step]

In the present embodiment, the decomposition step is followed by a diffusion step in which the heavy rare earth elements are further diffused. The diffusion can be carried out by adhering such as compounds including the heavy rare earth elements to a surface of the sintered body subjected to the decomposition step, and then subjecting it to heat treatment. The adhering method of the compounds including the heavy rare earth elements is not particularly limited, and it can be adhered by such as applying slurry including the heavy rare earth elements. In this case, the above $C_{RC}/C_{RS}$ can be controlled by controlling the coating amount of the slurry and the concentration of the heavy rare earth elements included in the slurry.

However, the adhering method of the heavy rare earth element is not particularly limited. For example, there are methods using vapor deposition, sputtering, electrodeposition, spray coating, brush coating, jet dispenser, nozzle, screen printing, squeegee printing, sheet method, etc.

When applying slurry, the heavy rare earth included compound is preferably in the form of grains. Further, the average grain diameter is preferably 100 nm or more and 50 μm or less, and more preferably 1 μm or more and 10 μm or less.

As the solvent used for the slurry, it is preferable to use a solvent capable of uniformly dispersing the heavy rare earth included compound without dissolving the compound. For example, alcohols, aldehydes, ketones, etc. can be exemplified, and among them, ethanol is preferable.

The content of the heavy rare earth included compound in the slurry is not particularly limited. For example, it may be 50 wt % or more and 90 wt % or less. If necessary, the slurry may further include components other than the heavy rare earth included compound. For example, dispersants for preventing aggregation of particles of the heavy rare earth included compound can be mentioned.

By performing the diffusion step on the sintered body subjected to the decomposition step, the heavy rare earth elements RH diffuse inside the nonuniform and finely structured main phase particles mainly existing in the magnet surface layer part, in addition to the grain boundaries of the entire sintered body.

The heat treatment conditions of the diffusion step is not particularly limited, however it is preferable to perform at 650° C. or more and 1000° C. or less for one hour or more and 24 hours or less. By setting temperature and time within the above range, it becomes easy to increase the ratio of the heavy rare earth elements RH incorporated in the finely structured particles. In the diffusion step, the respective components included in the above $H_2$ gas, CO gas or $N_2$ gas, or the oxidizing gas are released.

[Recombining Step]

Through the recombining step after the diffusion step, the finely structured particles are recombined and $R_2T_{14}B$ crystals are formed. The recombining step is carried out by such as rapidly cooling at a rate of 50° C./min or more and 500° C./min or less. The main phase particles obtained by the recombining become nonuniform and the low RH crystal phases are likely to generate. In addition, the non-magnetic R-rich phases are likely to generate. The reason why the main phase particles obtained by the recombining becomes nonuniform is that the main phase particles decompose nonuniformly in the decomposition step and that the heavy rare earth element RH diffused in the diffusion treatment step are unevenly taken into the finely structured particles in the decomposition step. Further, in the recombining step, the $R_2T_{14}B$ crystals including a large amount of the heavy rare earth elements RH start to recombine, and the $R_2T_{14}B$ crystals including a small amount of the heavy rare earth elements RH tend to be formed around the $R_2T_{14}B$ crystals including a large amount of the heavy rare earth elements RH. Consequently, nonuniform main phase particles are likely to be the reverse core-shell main phase particles. The cooling rate is not particularly limited, however, it tends to be fine crystals including many amorphous if the cooling rate is excessively fast, while, a boundary surface between the core part 11*a* and the shell part 11*b* of the reverse core-shell main phase particle 11 tend to be unclear if the cooling rate is excessively slow. Further, the cooling rate is preferably 200° C./min or more and 500° C./min or less. By setting the cooling rate within the above range, it becomes easy to preferably control the average size of the low RH crystal phases, N1–L1, the average size of the nonmagnetic R-rich phases and T/R ratio of the R-rich phases, and the coercive force tends to improve.

As mentioned, it is important that the production method of the R-T-B based sintered magnet of the present embodiment is carried out at least in the order of the decomposition step of decomposing the main phase particles included in the magnet surface layer part to disproportionate and make finer structure, the grain boundary diffusion step of diffusing the heavy rare earth elements in the finely structured particles, and the recombining step of recombining the finely structured particles. This makes it possible to form nonuniform main phase particles mainly in the magnet surface layer part of the R-T-B based sintered magnet. The methods and conditions of the above decomposition step, the grain boundary diffusion step, and the recombining step are merely examples. The decomposition step is sufficient as long as it is a step of decomposing and making a finer structured main phase particles in the magnet surface layer part. The grain boundary diffusion step is sufficient as long as it is a step of diffusing and the heavy rare earth elements in the finely pulverized particle. The recombining step is sufficient as long as it is a step of forming nonuniform main phase particle by recrystallization.

[Re-Aging Step]

Re-aging step is performed by heating the sintered magnet after the recombining step at a temperature lower than the maximum temperature of the diffusion step. Temperature and time of the re-aging is not particularly limited; however, it can be carried out such as at 450° C. or more and 800° C. or less for 0.2 hour or more and three hours or less.

The R-T-B based sintered magnet obtained by the above steps may be subjected to a surface treatment such as plating, resin coating, oxidation treatment, chemical conversion treatment, etc. As a result, the corrosion resistance can be further improved.

Further, a magnet obtained by cutting and dividing the R-T-B based sintered magnet of the present embodiment can be used.

Specifically, the R-T-B based sintered magnet of the present embodiment is suitably used for such as a motor, a compressor, a magnetic sensor, a speaker, etc.

In addition, the R-T-B based sintered magnet of the present embodiment may be used singly, or two or more magnets connected as necessary may be used. The connecting method is not particularly limited. For example, there are methods such as mechanically connected, connected by a resin mold, etc.

By connecting two or more R-T-B based sintered magnets, a large R-T-B based sintered magnet can be easily produced. Magnets in which two or more R-T-B based sintered magnets are connected are preferably used for applications requiring particularly large R-T-B based sintered magnets, such as IPM motors, wind power generators, large motors, etc.

EXAMPLE

Hereinafter, the invention will be described in detail referring to examples; however, the invention is not limited thereto.

(Production Step of Sintered Magnet)

Nd, electrolytic iron, low carbon ferroboron alloy were prepared as raw material metals. Furthermore, Al, Cu, Co and Zr were prepared in a form of a pure metal or an alloy with Fe.

An alloy for the sintered body (a raw material alloy) was produced from the raw material metal by the strip casting method so that the composition of the sintered magnet becomes the composition shown in the column of alloy A in the latter described Table 1. The content (wt %) of each element shown in Table 1 is a value when the total content of Nd, B, Al, Cu, Co, Zr and Fe is taken as 100 wt %. In addition, the alloy thickness of the material alloy was set to 0.2 mm to 0.6 mm.

Subsequently, hydrogen was stored to the raw material alloy by hydrogen gas flow at room temperature for one hour. Then, the atmosphere was changed to Ar gas, dehydrogenation was carried out at 450° C. for one hour, and the raw material alloy was hydrogen pulverized. Further, after cooling, a powder having a grain size of 400 μm or less was obtained by using a sieve.

Then, oleic acid amide in an amount of 0.1 wt % was added as a pulverization aid to the powder of the raw material alloy after hydrogen pulverization, and mixed thereof.

Next, using a collision plate type jet mill device, a fine pulverization was carried out in a nitrogen stream to obtain a fine powder (a raw material powder) each having an average grain diameter of approximately 4 μm. The average grain diameter is the average grain diameter D50 measured by a laser diffraction type grain diameter distribution meter.

According to the elements not listed in Table 1, H, Si, Ca, La, Ce, Cr, etc. may be detected in some cases. Si is mainly mixed from a ferroboron raw material and crucible at melting of alloy. Ca, La and Ce are mixed from the rare earth raw material. Also, there is a possibility that Cr is mixed from an electrolytic iron.

The obtained fine powder was pressed in a magnetic field to produce a green compact. The applied magnetic field at this time was a static magnetic field of 1200 kA/m. The pressure applied when pressing was 120 MPa. In addition, the magnetic field application direction and the pressing direction were orthogonalized. When density of the green compact was measured at this point, the densities of all the green compacts were within the range of 4.10 $Mg/m^3$ or more and 4.25 $Mg/m^3$ or less.

Next, the green compact was sintered to obtain a sintered magnet. The sintering conditions were maintained at 1060° C. for four hours. The sintering atmosphere was vacuum. The sintered density at the time was in the range of 7.50 $Mg/m^3$ or more and 7.55 $Mg/m^3$ or less. Thereafter, a first aging was carried out for one hour at a first aging temperature T1=900° C. in an Ar atmosphere under an atmospheric pressure, and further a second aging was carried out for one hour at a second aging temperature T2=500° C.

The composition of the obtained sintered magnet was evaluated by fluorescent X-ray analysis. B content was evaluated by ICP. It was confirmed that the composition of the sintered magnet in each sample is as shown in Table 2. Then, the obtained sintered magnets were subjected to the processes of Examples 1 to 11 and Comparative Examples 1 described hereinafter.

Example 1

The sintered magnet obtained by the above process was processed into a rectangular parallelepiped having a width of 20 mm, a length of 20 mm, and a thickness in the orientation direction of 5 mm, and was then immersed in an atmosphere gas of 5 vol % of hydrogen and 95 vol % of Ar, and held at 750° C. for 10 minutes to decompose and disproportionate the main phase particles, mainly existing in the magnet surface layer part.

Next, a slurry in which $TbH_2$ particles (average grain diameter D50=5 μm) are dispersed in ethanol was applied to the entire surface of the sintered magnet so that the weight of Tb with respect to that of the sintered magnet became 0.5 wt %. Tb was then adhered to the sintered magnet After coating the slurry, the heat treatment was carried out at 770° C. for five hours in Ar flow at atmospheric pressure, followed by the heat treatment at 950° C. for five hours. Tb was grain boundary diffused. Tb was then diffused even in the finely structured main phase particles.

After the heat treatment, it was rapidly cooled at a cooling rate of 200° C./min., and the finely structured particles were recombined.

Thereafter, the re-aging was carried out at 500° C. for one hour in Ar atmosphere at atmospheric pressure.

For the sintered magnet after the re-aging, the magnetic properties of residual magnetic flux density Br, coercive force Hcj and squareness ratio Hk/Hcj were evaluated with B-H tracer.

Example 2

The sintered magnet obtained by the above steps was held at 700° C. for 10 minutes in an atmospheric gas having 8 vol % of CO and 92 vol % of Ar to disproportionate and to make finely structured main phase particles, mainly present in the magnet surface layer part.

Next, a slurry in which $TbH_2$ particles (average grain diameter D50=5 μm) are dispersed in ethanol was applied to the entire surface of the sintered magnet so that the weight ratio of Tb with respect to that of the sintered magnet became 0.5 wt %. Tb was then adhered to the sintered magnet. After coating the slurry, the heat treatment was carried out at 770° C. for five hours in Ar flow at atmospheric pressure, followed by the heat treatment at 950° C. for five hours. Tb was then diffused even in the finely structured particles.

After the heat treatment, it was rapidly cooled at a cooling rate of 200° C./min., and the finely structured particles were recombined.

Thereafter, the re-aging was carried out at 500° C. for one hour in Ar atmosphere at atmospheric pressure.

For the sintered magnet after the re-aging, the magnetic properties of residual magnetic flux density Br, coercive force Hcj and squareness ratio Hk/Hcj were evaluated with B-H tracer.

Example 3

The sintered magnet obtained by the above steps was held at 650° C. for 30 minutes in an atmospheric gas having 8 vol % of $N_2$ and 92 vol % of Ar to disproportionate and to make finely structured main phase particles mainly present in the magnet surface layer part.

Next, a slurry in which $TbH_2$ particles (average grain diameter D50=5 μm) are dispersed in ethanol was applied to the entire surface of the sintered magnet so that the weight ratio of Tb with respect to that of the sintered magnet became 0.5 wt %. Tb was then adhered to the sintered magnet. After coating the slurry, the heat treatment was carried out at 770° C. for five hours in Ar flow at atmospheric pressure, followed by the heat treatment at 950° C. for five hours. Tb was then diffused even in the finely structured particles.

After the heat treatment, it was rapidly cooled at a cooling rate of 200° C./min., and the finely structured particles were recombined Thereafter, the re-aging was carried out at 500° C. for one hour in Ar atmosphere at atmospheric pressure.

For the sintered magnet after the re-aging, the magnetic properties of residual magnetic flux density Br, coercive force Hcj and squareness ratio Hk/Hcj were evaluated with B-H tracer.

Example 4

The sintered magnet obtained by the above steps was held at 400° C. for 300 minutes in an oxidizing atmosphere including a gas whose vapor partial pressure was adjusted to 200 hPa, to disproportionate and to make finely structured main phase particles existing in the magnet surface layer part.

Next, a slurry in which $TbH_2$ particles (average grain diameter D50=5 rpm) are dispersed in ethanol was applied to the entire surface of the sintered magnet so that the weight ratio of Tb with respect to that of the sintered magnet became 0.5 wt %. Tb was then adhered to the sintered magnet. After coating the slurry, the heat treatment was carried out at 770° C. for five hours in Ar flow at atmospheric pressure, followed by the heat treatment at 950° C. for five hours. Tb was then diffused even in the finely structured particles.

After the heat treatment, it was rapidly cooled at a cooling rate of 200° C./min., and the finely structured particles were recombined.

Thereafter, the re-aging was carried out at 500° C. for one hour in Ar atmosphere at atmospheric pressure.

For the sintered magnet after the re-aging, the magnetic properties of residual magnetic flux density Br, coercive force Hcj and squareness ratio Hk/Hcj were evaluated with B-H tracer.

Example 5

The steps were carried out in the same manner as in Example 1 except that the $TbH_2$ particles (average grain diameter D50=5 μm) were replaced with the particles in which $TbH_2$ particles (average grain diameter D 50=5 μm) and $NdH_2$ particles (average grain diameter D50=5 μm) are mixed to be Tb:Nd=80:20. Tb and Nd were adhered making the weight of Tb with respect to the weight of the sintered magnet to 0.5 wt %.

Example 6

The steps were carried out in the same manner as in Example 1 except that the $TbH_2$ particles (average grain diameter D50=5 μm) were replaced with the particles in which $TbH_2$ particles (average grain diameter D 50=5 μm) and $NdH_2$ particles (average grain diameter D50=5 μm) are mixed to be Tb:Nd=70:30. Tb and Nd were adhered making the weight of Tb with respect to the weight of the sintered magnet to 0.5 wt %.

Example 7

The steps were carried out in the same manner as in Example 1 except that the holding time in an atmosphere gas having 5 vol % of hydrogen and 95 vol % of Ar was 20 minutes.

Example 8

The steps were carried out in the same manner as in Example 1 except that the holding time in an atmosphere gas having 5 vol % of hydrogen and 95 vol % of Ar was 30 minutes.

Example 9

The steps were carried out in the same manner as in Example 1 except that the cooling rate after the heat treatment was set to 50° C./min.

Example 10

The steps were carried out in the same manner as in Example 1 except that the cooling rate after the heat treatment was set to 500° C./min.

Example 11

The sintered magnet obtained by the above steps was held at 750° C. for 10 minutes in an $H_2$ gas to disproportionate and to make finely structured main phase particles mainly present in the magnet surface layer part.

Next, a slurry in which $TbH_2$ particles (average grain diameter D50=5 μm) are dispersed in ethanol was applied to the entire surface of the sintered magnet so that the weight ratio of Tb with respect to that of the sintered magnet became 0.5 wt %. Tb was then adhered to the sintered magnet. After coating the slurry, the heat treatment was carried out at 770° C. for five hours in Ar flow at atmospheric pressure, followed by the heat treatment at 820° C. for five hours. Tb was then diffused even in the finely structured particles.

After the heat treatment, it was rapidly cooled at a cooling rate of 200° C./min., and the decomposed main phase particles were recombined.

Thereafter, the re-aging was carried out at 500° C. for one hour in Ar atmosphere at atmospheric pressure.

For the sintered magnet after the re-aging, the magnetic properties of residual magnetic flux density Br, coercive force Hcj and squareness ratio Hk/Hcj were evaluated with B-H tracer.

Comparative Example 1

Next, a slurry in which $TbH_2$ particles (average grain diameter D50=5 μm) are dispersed in ethanol was applied to the entire surface of the sintered magnet obtained by the above-mentioned production step of sintered magnet. Thus, Tb was adhered by the weight ratio of Tb with respect to the weight of the sintered magnet to 0.5 wt %

The heat treatment was carried out at 770° C. for five hours in Ar flow at atmospheric pressure, followed by the heat treatment at 950° C. for five hours. After the heat treatment, it was rapidly cooled at a cooling rate of 200° C./min.

Thereafter, the re-aging was carried out at 500° C. for one hour in Ar atmosphere at atmospheric pressure.

For the sintered magnet after the re-aging, the magnetic properties of residual magnetic flux density Br, coercive force Hcj and squareness ratio Hk/Hcj were evaluated with B-H tracer.

Comparative Example 2

In the production steps of the sintered magnet according to Comparative Example 2, the alloys for sintered bodies (raw material alloys) B and C were produced so as to have the composition shown in Table 1. The raw material alloy B and the raw material alloy C shown in Table 1 were hydrogen-pulverized, and then mixed to have the weight ratio of 9:1. Then, fine pulverization, pressing, sintering and aging were carried out in the same manner as in Example 1 to obtain a sintered magnet having the composition shown in Table 2. It was confirmed that the composition of the sintered magnet was the same as that of the sintered magnets of Examples 1 to 4, 7 to 11 and Comparative Example 1 after the diffusion.

For the sintered magnet after the aging, the magnetic properties of residual magnetic flux density Br, coercive force Hcj and squareness ratio Hk/Hcj were evaluated with B-H tracer.

Table 3 shows whether the decomposition for decomposing the main phase particles present in the surface layer part of the sintered magnet, grain boundary diffusion, and rapid cooling after the grain boundary diffusion were carried out. "Done" is given when each process was performed, "Not Done" is given when each process was not performed.

Table 3 shows the evaluation results of the magnetic properties of residual magnetic flux density Br, coercive force Hcj and squareness ratio Hk/Hcj with respect to the sintered magnets of the respective Examples and Comparative Examples with B-H tracer. The residual magnetic flux density Br of 1380 mT or more was defined preferable, and 1400 mT or more was defined further preferable. The coercive force Hcj was defined preferable when 1790 kA/m or more, and more preferable when 1830 kA/m or more, when Tb was grain boundary diffused. The coercive force Hcj was defined preferable when 1790 kA/m or more, and more preferable when 1830 kA/m or more. When the squareness ratio Hk/Hcj was 0.95 or more, it was regarded preferable.

The number of low RH crystal phases included in one main phase particle was confirmed. Specifically, a cross section cut at a section of 20 μm from the magnet surface toward the inside of the magnet was observed. Then, 50 main phase particles included in the cross section were randomly selected, and the number of low RH crystal phases included in each main phase particle was counted. Table 4 shows the maximum number of the counted low RH crystal phases. When the maximum number was one, it was determined that there was no main phase particle including a plurality of low RH crystal phases.

Further, each Example and Comparative Example was cut at an arbitrary cross section, and the cross section was observed. The existence ratio $r_s$ (%) of the particles including the low RH crystal phases in the magnet surface layer part and the existence ratio $r_c$ (%) of the particles including the low RH crystal phases in the magnet central part were measured by SEM-EDS, TEM and TEM-EDS. Specifically, 10 main phase particles were selected in each of the magnet surface layer part and the magnet central part, and it was measured how many of the 10 particles included the low RH crystal phase. The results are shown in Table 4.

Further, for each example and comparative example, the ratio ($r_{sh}$) (%) of the particles including the low RH crystal phases and the nonmagnetic R-rich phases in the magnet surface layer part and the existence ratio ($r_{ch}$) (%) of the low RH crystal phases and the nonmagnetic R-rich phases in the magnet central part were measured by SEM, SEM-EDS, TEM and TEM-EDS. The results are shown in Table 4.

In addition, existence ratio of the reverse core-shell main phase particles in a region of 20 μm from the surface of the magnet toward the inside of the magnet in the magnet surface layer part was measured. The measurement of the existence ratio of the reverse core-shell main phase particles in the magnet surface layer part was carried out with respect to 10 main phase particles randomly selected from the main phase particles in the part of 20 μm from the magnet surface toward the inside of the magnet, using SEM and TEM-EDS. Also, the existence ratio of the reverse core-shell main phase particles in the magnet central part was measured. Measurement of the existence ratio of the reverse core-shell main phase particles in the magnet central part was carried out by using SEM and TEM-EDS for 10 main phase particles randomly selected from the main phase particles in the magnet central part. The results are shown in Table 4.

Further, with respect to the reverse core-shell main phase particles present in the magnet surface layer part in each example, the total RH concentration $C_{RC}$ in the core part and the total RH concentration $C_{RS}$ in the shell part were measured. The ratio of particles having $C_{RC}/C_{RS}>1.5$ and the same having $C_{RC}/C_{RS}>3.0$ in each reverse core-shell main phase particles were calculated using TEM-EDS. The results are shown in Table 4.

According to the reverse core-shell main phase particles 11 of this example, the measurement points of the total RH concentration in the core part 11*a* and the same in the shell part 11*b* are as follows.

First, the reverse core-shell main phase particles 11 for measuring the concentration was observed with transmission electron microscope (TEM), and the diameter having the maximum length was specified. Next, two intersection points of the diameter and the grain boundary were specified. Then, the total RH concentration in a region of 20 nm×20 nm centered on a midpoint of the two intersection points were measured, and defined as the total RH concentration $C_{RC}$ in the core part.

Next, one of the two intersection points was selected. Then, the total RH concentration in a region of 20 nm×20 nm centered at the point, penetrating the reverse core-shell main phase particle side by 20 nm apart from the intersection point along the diameter having the maximum length, was measured and referred to as the total RH concentration $C_{RS}$ in the shell part.

The existence ratio of the core-shell main phase particles in the magnet surface layer part, the existence ratio of the core-shell main phase particles in the magnet central part, and the existence ratio of the non-core-shell main phase particles in the magnet central part were measured by SEM and TEM-EDS. Results are shown in Table 4.

The existence ratio of the reverse core-shell particles including the low RH crystal phases and the nonmagnetic R-rich phases in the core part at the magnet surface layer part were measured by SEM, SEM-EDS, TEM and TEM-EDS. Results are shown in Table 4.

Further, the average size of the low RH crystal phases was measured in Examples 1, 9 and 10, in which the test conditions were the same except the cooling rate after the heat treatment. Specifically, a cross section cut at a section of 20 μm from the magnet surface toward inside of the magnet was observed. Then, 50 main phase particles included in the cross section were randomly selected, and the sizes of the low RH crystal phases included in each main phase particle were averaged. The results are shown in Table 5.

Further, the average value of N1−L1 was measured. Specifically, a cross section cut at a section of 20 μm from the magnet surface toward the inside of the magnet was observed. Then, 50 low RH crystal phases included in the cross section were randomly selected, N1−L1 was measured for each low RH crystal phases, and averaged. The results are shown in Table 5.

Further, the average size and T/R ratio of the R-rich phases were measured. Specifically, a cross section cut at a section of 20 μm from the magnet surface toward inside of the magnet was observed. Then, 50 main phase particles included in the cross section were randomly selected, and the sizes of all R rich phases included in the main phase particles were averaged. Further, T/R ratios of all the R-rich phases included in the main phase particles were measured and averaged. The results are shown in Table 5.

TABLE 1

| Composition of raw material alloy | Nd | Al | Co | Cu | Zr | B | Tb | Fe |
|---|---|---|---|---|---|---|---|---|
| | wt % | | | | | | | |
| Alloy A (Exs. 1 to 11, Comp. Ex. 1) | 30.5 | 0.21 | 0.5 | 0.1 | 0.15 | 1.01 | 0.0 | Bal. |
| Alloy B (Comp. Ex. 2) | 31.0 | 0.23 | 0.0 | 0.0 | 0.17 | 1.11 | 0.0 | Bal. |
| Alloy C (Comp. Ex. 2) | 24.0 | 0.00 | 5.0 | 1.0 | 0.00 | 0.00 | 5.0 | Bal. |

TABLE 2

| Composition of Sintered Magnet Before Grain Boundary Diffusion | Nd | Al | Co | Cu | Zr | B | Tb | Fe |
|---|---|---|---|---|---|---|---|---|
| | wt % | | | | | | | |
| Exs. 1 to 11, Comp. Ex. 1 | 30.5 | 0.21 | 0.5 | 0.1 | 0.15 | 1.01 | 0.0 | Bal. |
| Comp. Ex. 2 | 30.3 | 0.21 | 0.5 | 0.1 | 0.15 | 1.00 | 0.5 | Bal. |

TABLE 3

| | Decomposition | Grain Boundary Diffusion | Rapid Cooling | Residual Magnetic Flux Density Br (mT) | Coercive Force HcJ (kA/m) | Squareness Ratio Hk/HcJ |
|---|---|---|---|---|---|---|
| Ex. 1 | Done | Done | Done | 1420 | 1850 | 0.97 |
| Ex. 2 | Done | Done | Done | 1420 | 1840 | 0.96 |
| Ex. 3 | Done | Done | Done | 1420 | 1830 | 0.95 |
| Ex. 4 | Done | Done | Done | 1420 | 1840 | 0.96 |
| Ex. 5 | Done | Done | Done | 1420 | 1830 | 0.95 |
| Ex. 6 | Done | Done | Done | 1420 | 1810 | 0.95 |
| Ex. 7 | Done | Done | Done | 1400 | 1850 | 0.96 |
| Ex. 8 | Done | Done | Done | 1380 | 1840 | 0.96 |
| Ex. 9 | Done | Done | Done | 1400 | 1810 | 0.95 |
| Ex. 10 | Done | Done | Done | 1400 | 1830 | 0.98 |
| Ex. 11 | Done | Done | Done | 1420 | 1790 | 0.95 |
| Comp. Ex. 1 | Not Done | Done | Done | 1420 | 1770 | 0.90 |
| Comp. Ex. 2 | Not Done | Not Done | Not Done | 1370 | 1290 | 0.91 |

TABLE 4

| | Low RH Crystal Phase | | Low RH Crystal Phase + Nonmagnetic R-rich Phase | | Maximum Number of Low RH Crystal Phases | Existence Ratio (%) of the Reverse Core Shell Particles in | Existence Ratio (%) of the Reverse Core Shell Particles in | Ratio (%) of the Reverse Core Shell | Ratio (%) of the Reverse Core Shell | Existence Ratio (%) of the Reverse Core Shell Particles Including Low RH Crystal Phase and Nonmagnetic R-rich |
|---|---|---|---|---|---|---|---|---|---|---|
| | surface layer part $r_s$ (%) | central part $r_c$ (%) | surface layer part $r_{sh}$ (%) | central part $r_{ch}$ (%) | Included in Main Phase Particle | the Magnet Surface Layer Part | the Magnet Central Part | Particles Satisfying $C_{RC}/C_{RS}$ >1.5 | Particles Satisfying $C_{RC}/C_{RS}$ >3.0 | Phase in the Magnet Surface Layer Part |
| Ex. 1 | 90 | 0 | 80 | 0 | 11 | 100 | 0 | 100 | 100 | 70 |
| Ex. 2 | 70 | 0 | 70 | 0 | 9 | 80 | 0 | 100 | 100 | 60 |
| Ex. 3 | 70 | 0 | 70 | 0 | 7 | 70 | 0 | 100 | 100 | 60 |
| Ex. 4 | 60 | 0 | 60 | 0 | 9 | 80 | 0 | 100 | 100 | 60 |
| Ex. 5 | 60 | 0 | 60 | 0 | 8 | 70 | 0 | 100 | 86 | 50 |
| Ex. 6 | 40 | 0 | 30 | 0 | 7 | 60 | 0 | 83 | 67 | 30 |
| Ex. 7 | 90 | 0 | 70 | 0 | 10 | 100 | 0 | 100 | 100 | 60 |
| Ex. 8 | 80 | 0 | 50 | 0 | 9 | 100 | 0 | 90 | 80 | 40 |
| Ex. 9 | 50 | 0 | 40 | 0 | 3 | 70 | 0 | 86 | 71 | 30 |
| Ex. 10 | 60 | 0 | 40 | 0 | 4 | 80 | 0 | 88 | 75 | 30 |
| Ex. 11 | 50 | 0 | 40 | 0 | 2 | 0 | 0 | | | |
| Comp. Ex. 1 | 20 | 10 | 10 | 0 | 1 | 0 | 0 | | | |
| Comp. Ex. 2 | 20 | 20 | 10 | 10 | 1 | 0 | 0 | | | |

TABLE 5

| | Cooling Rate After the Heat Treatment (° C./min) | Low RH Crystal Phases: Surface Layer Part $r_S$ (%) | Low RH Crystal Phases: Average Size of Low RH Crystal Phases (nm) | Low RH Crystal Phases: N1-L1 | Nonmagnetic R-rich Phases: Average size of R-rich phases (nm) | Nonmagnetic R-rich Phases: T/R ratio of the R-rich phases (atomic ratio) | Residual Magnetic Flux Density Br (mT) | Coercive Force HcJ (kA/m) | Squareness Ratio Hk/HcJ |
|---|---|---|---|---|---|---|---|---|---|
| Ex. 1 | 200 | 90 | 300 | 0.50 | 100 | 0.11 | 1420 | (Ka/m) | 0.97 |
| Ex. 9 | 50 | 50 | 600 | 0.22 | 150 | 0.18 | 1400 | 1810 | 0.95 |
| Ex. 10 | 500 | 60 | 150 | 0.31 | 50 | 0.15 | 1400 | 1830 | 0.98 |

From Tables 1 to 4, it is shown that the R-T-B based sintered magnets of Examples 1 to 11 which went through the step of disproportionating and making fine structured main phase particles of the magnet surface layer part after sintering, the step of incorporating RH into the finely structured particles by the grain boundary diffusion, the step of recombinding the particles in which RH is incorporated by a rapid cooling, had the main phase particles including a plural number of the low RH crystal phases, and obtained preferable residual magnetic flux density Br, coercive force Hcj and the squareness ratio Hk/Hcj.

Furthermore, in the R-T-B based sintered magnets of Examples 1 to 11, a large number of nonuniform main phase particles having the low RH crystal phases were formed in the magnet surface layer part more than the magnet central part. As a result, the residual magnetic flux density Br and the coercive force Hcj became more preferable.

Furthermore, in Examples 1 to 5 and 7, a large number of nonuniform main phase particles having the low RH crystal phases and the nonmagnetic R-rich phases were generated more in the magnet surface layer part than in the magnet central part. As a result, the residual magnetic flux density Br and the coercive force Hcj became more preferable.

Further, in Examples 1 to 10, the reverse core-shell main phase particles were formed in the magnet surface layer part. As a result, the residual magnetic flux density Br and the coercive force Hcj were preferable. Further, Examples 1 to 5, 7 and 8, in which the ratio of the reverse core-shell main phase particles having $C_{RC}/C_{RS}>1.5$ among the reverse core-shell main phase particles was 90% or more, showed more preferable coercive force Hcj.

Further, in Examples 1 to 5 and 7 in which the existence ratio of the reverse core-shell including the low RH crystal phases and the nonmagnetic R-rich phases in the core part at the magnet surface layer part was 50% or more, showed more preferable coercive force Hcj and residual magnetic flux density Br.

Further, Table 5 shows the following. Examples 1 and 10 in which the average size of the low RH crystal phases was 150 to 300 nm, the average value of N1−L1 was 0.3 or more, the average size of the R-rich phases was 50 to 100 nm and the T/R ratio of the R-rich phases was 0.11 to 0.15 showed higher coercive force Hcj than the same of Example 9, in which the average size of the low RH crystal phases, the average value of N1−L1, the average size of the R-rich phases and the T/R ratio of the R-rich phases were outside the above ranges.

On the other hand, according to the R-T-B based sintered magnets of comparative examples which did not go through the step of disproportionating and making finely structured main phase particles of the magnet surface layer part after sintering, the step of incorporating RH into the finely structured particles by the grain boundary diffusion, the step of recombinding the particles in which RH is incorporated by a rapid cooling, nonuniform main phase particles including a plural number of the low RH crystal phases were not included. As a result, residual magnetic flux density Br, coercive force Hcj and/or squareness rate Hk/Hcj were inferior to those of the Examples 1 to 11.

In Comparative Example 1, since the process of disproportionating and making finely structured main phase particles in the magnet surface layer part after sintering was not carried out, the nonuniform main phase particles including the low RH crystal phases were not formed in the magnet surface layer part even through the grain boundary diffusion and the rapid cooling. In Comparative Example 2, the sintered magnet was produced by the two-alloy method, but the nonuniform main phase particles including the low RH crystal phases were not much formed in the magnet surface layer part.

EXPLANATION OF REFERENCES

11: Nonuniform main phase particle (reverse core-shell main phase particle)
11*a*: Core part
11*b*: Shell part
21: Low RH crystal phase
23: Nonmagnetic R-rich phase

The invention claimed is:

1. An R-T-B based sintered magnet including a plural number of main phase grains comprising an $R_2T_{14}B$ crystal structure, wherein R is at least one rare earth element essentially comprising a heavy rare-earth element RH, T is at least one transition metal element essentially comprising Fe or Fe and Co, and B is boron, at least one of the main phase grains comprises a plural number of low RH crystal phases and a nonmagnetic R-rich phase inside the main phase grain, and the low RH crystal phases comprise the $R_2T_{14}B$ crystal structure, a difference between an RH concentration in the low RH crystal phases (L1) and an RH concentration around the low RH crystal phases (N1) in the main phase grain satisfies the following inequality:

$$N1-L1>0.2,$$

wherein L1 is defined as the RH concentration (at %)/total light rare earth element (RL) concentration (at %) in the low RH crystal phase, and N1 is defined as the RH concentration (at %)/the total RL concentration (at %) in the main phase existing around the low RH crystal phase.

2. The R-T-B based sintered magnet according to claim 1, wherein at least one of the main phase grains is a reverse core-shell main phase grain comprising a shell part and a core part covered by the shell part, and $C_{RC}/C_{RS}>1.0$ is satisfied, where $C_{RC}$ is an RH concentration (at %) in the core part, and $C_{RS}$ is an RH concentration (at %) in the shell part.

3. The R-T-B based sintered magnet according to claim 2, wherein the core part comprises the low RH crystal phase.

4. The R-T-B based sintered magnet according to claim 3, wherein the core part further comprises the nonmagnetic R-rich phase.

* * * * *